US007185483B2

(12) United States Patent
Czachor

(10) Patent No.: US 7,185,483 B2
(45) Date of Patent: Mar. 6, 2007

(54) METHODS AND APPARATUS FOR EXCHANGING HEAT

(75) Inventor: Robert P. Czachor, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 194 days.

(21) Appl. No.: 10/348,561

(22) Filed: Jan. 21, 2003

(65) Prior Publication Data

US 2004/0139722 A1 Jul. 22, 2004

(51) Int. Cl.
*F02C 7/10* (2006.01)
*F28F 3/12* (2006.01)

(52) U.S. Cl. ..... 60/39.511; 60/801; 165/167

(58) Field of Classification Search ..... 165/166, 165/167, 54; 60/722, 39.511, 801
See application file for complete search history.

(56) References Cited

U.S. PATENT DOCUMENTS

| | | | | |
|---|---|---|---|---|
| 2,970,437 | A | 2/1961 | Anderson | |
| 2,979,293 | A | 4/1961 | Mount | |
| 3,038,308 | A | 6/1962 | Fuller | |
| 3,831,374 | A * | 8/1974 | Nicita | 60/39.511 |
| 3,974,642 | A | 8/1976 | Pacault | |
| 4,187,675 | A | 2/1980 | Wakeman | |
| 4,773,212 | A | 9/1988 | Griffin et al. | |
| 5,193,611 | A * | 3/1993 | Hesselgreaves | 165/165 |
| 5,267,608 | A | 12/1993 | Coffinberry | |
| 5,297,386 | A | 3/1994 | Kervistin | |
| 5,317,877 | A | 6/1994 | Stuart | |
| 5,729,969 | A | 3/1998 | Porte | |
| 5,782,076 | A | 7/1998 | Huber et al. | |
| 6,035,627 | A * | 3/2000 | Liu | 60/785 |
| 6,050,080 | A | 4/2000 | Horner | |
| 6,065,282 | A | 5/2000 | Fukue et al. | |
| 6,253,554 | B1 | 7/2001 | Kobayashi et al. | |
| 6,295,803 | B1 | 10/2001 | Bancalari | |
| 6,307,278 | B1 * | 10/2001 | Nims et al. | 290/52 |
| 6,438,936 | B1 * | 8/2002 | Ryan | 60/39.511 |
| 6,634,419 | B1 * | 10/2003 | Beldam et al. | 165/146 |
| 6,684,943 | B2 * | 2/2004 | Dobbs et al. | 165/166 |

FOREIGN PATENT DOCUMENTS

| | | |
|---|---|---|
| GB | 2 072 268 | 9/1981 |

OTHER PUBLICATIONS

"How to Use Fuel as a Heat Sink," G.L. Roth and O.L. Williamson, published in *Space/Aeronautics* Mar. 1960).

* cited by examiner

*Primary Examiner*—Charles G. Freay
(74) *Attorney, Agent, or Firm*—William Scott Andes; Armstrong Teasdale LLP

(57) ABSTRACT

A method for exchanging heat between a first fluid and a second fluid. The method includes providing a heat exchanger having a stack of at least two layers of support structures, wherein each support structure layer is formed from a lattice of support members, and substantially fluidly separating the at least two support structure layers using at least one barrier such that each layer defines a fluid passageway. The method also includes directing a flow of first fluid through a first of the fluid passageways, and directing a flow of second fluid through a second of the fluid passageways that is adjacent the first fluid passageway to facilitate exchanging heat between the first and second fluids.

12 Claims, 5 Drawing Sheets

METHODS AND APPARATUS FOR EXCHANGING HEAT

BACKGROUND OF THE INVENTION

This invention relates generally to heat exchange, and more specifically, to methods and apparatus for exchanging heat within a gas turbine engine.

Gas turbine engines typically include a compressor for compressing air. The compressed air is mixed with a fuel and channeled to a combustor, wherein the fuel/air mixture is ignited within a combustion chamber to generate hot combustion gases. The combustion gases are channeled to a turbine, which extracts energy from the combustion gases for powering the compressor, as well as producing useful work to propel an aircraft in flight or power a load, such as an electrical generator.

At least some known gas turbine engines use heat exchangers to improve an efficiency of the gas turbine engine, for example, by increasing the temperature of air discharged from the compressor, or decreasing the temperature of air used to cool the turbine. At least some known gas turbine engines also use heat exchangers to decrease the temperature of gases exhaust from the turbine. Heat exchangers typically include a plurality of small diameter tubes that carry a first fluid therein and are suspended in a cross-flow of a second fluid. As the first fluid flows through the tubes and second fluid flows over the surface area of the tubes, the first and second fluids exchange heat. However, such heat exchangers can be complex and include a plurality of brazed joints, and may therefore be difficult to manufacture. In addition, the brazed joints or others areas of the tubes may crack under loading, thereby possibly mixing the first and second fluids.

BRIEF DESCRIPTION OF THE INVENTION

In one aspect, a method is provided for exchanging heat between a first fluid and a second fluid. The method includes providing a heat exchanger having a stack of at least two layers of support structures, wherein each support structure layer is formed from a lattice of support members, and substantially fluidly separating the at least two support structure layers using at least one barrier such that each layer defines a fluid passageway. The method also includes directing a flow of the first fluid through a first of the fluid passageways, and directing a flow of second fluid through a second of the fluid passageways that is adjacent the first fluid passageway to facilitate exchanging heat between the first and second fluids.

In another aspect, a heat exchanger is provided for exchanging heat between a first fluid and a second fluid. The heat exchanger includes a stack of at least two layers of support structures, wherein said support structure layer is formed from a lattice of support members, and at least one barrier coupled to at least one of the support structure layers such that the at least one barrier substantially fluidly separates the at least two support structure layers such that each layer defines a fluid passageway. The at least one barrier is configured to facilitate exchanging heat between the first fluid and the second fluid when the first fluid is directed through a first of the fluid passageways and the second fluid is directed through a second of the fluid passageways that is adjacent the first fluid passageway.

In yet another aspect, a gas turbine engine is provided that includes at least one compressor, and at least one turbine assembly downstream from and in flow communication with the compressor. The turbine assembly includes at least one exhaust. The engine also includes a heat exchanger that includes a stack of at least two layers of support structures, wherein each support structure layer is formed from a lattice of support members, and at least one barrier coupled to at least one support structure layer such that the at least one barrier substantially fluidly separates at least two of the support structure layers such that each layer defines a fluid passageway. The at least one barrier is configured to facilitate exchanging heat between compressed air that is discharged from the at least one compressor and a second fluid when the compressed air is directed through a first of the fluid passageways and the second fluid is directed through a second of the fluid passageways that is adjacent the first fluid passageway.

DETAILED DESCRIPTION OF THE INVENTION

Although the invention is herein described and illustrated in association with a gas turbine engine, it should be understood that the present invention may be used for generally exchanging heat within any system, and anywhere within a gas turbine engine. Accordingly, practice of the present invention is not limited to gas turbine engines and the specific embodiments described herein.

Figure 1:
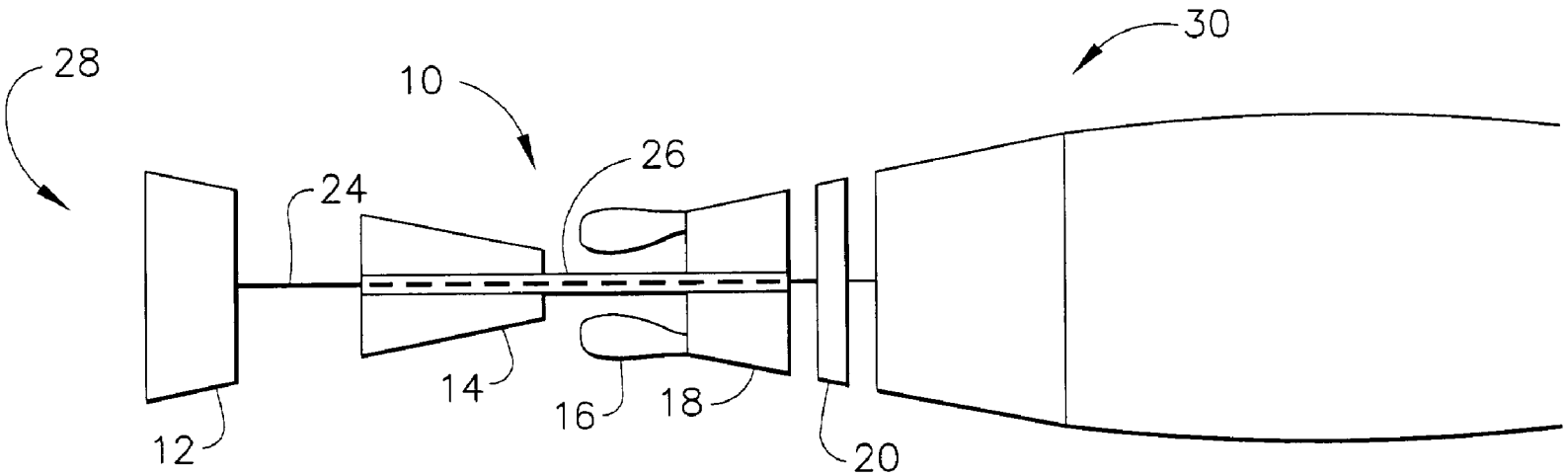
FIG. 1 is a schematic illustration of an exemplary gas turbine engine.

FIG. 1 is a schematic illustration of a gas turbine engine 10 including a low-pressure compressor 12, a high-pressure compressor 14, and a combustor 16. Engine 10 also includes a high-pressure turbine 18 and a low-pressure turbine 20. Compressor 12 and turbine 20 are coupled by a first shaft 24, and compressor 14 and turbine 18 are coupled by a second shaft 26. Engine 10 has an intake, or upstream, side 28 and an exhaust, or downstream, side 30. In one embodiment, engine 10 is a turbine engine commercially available from General Electric Power Systems, Schenechtady, N.Y.

In operation, air flows through low-pressure compressor 12 and high-pressure compressor 14 to combustor 16, wherein the compressed air is mixed with a fuel and ignited to generate hot combustion gases. The combustion gases are discharged from combustor 16 into a turbine nozzle assembly (not shown in FIG. 1) that includes a plurality of nozzles (not shown in FIG. 1) and is used to drive turbines 18 and 20. Turbine 20, in turn, drives low-pressure compressor 12, and turbine 18 drives high-pressure compressor 14.

Figure 2:
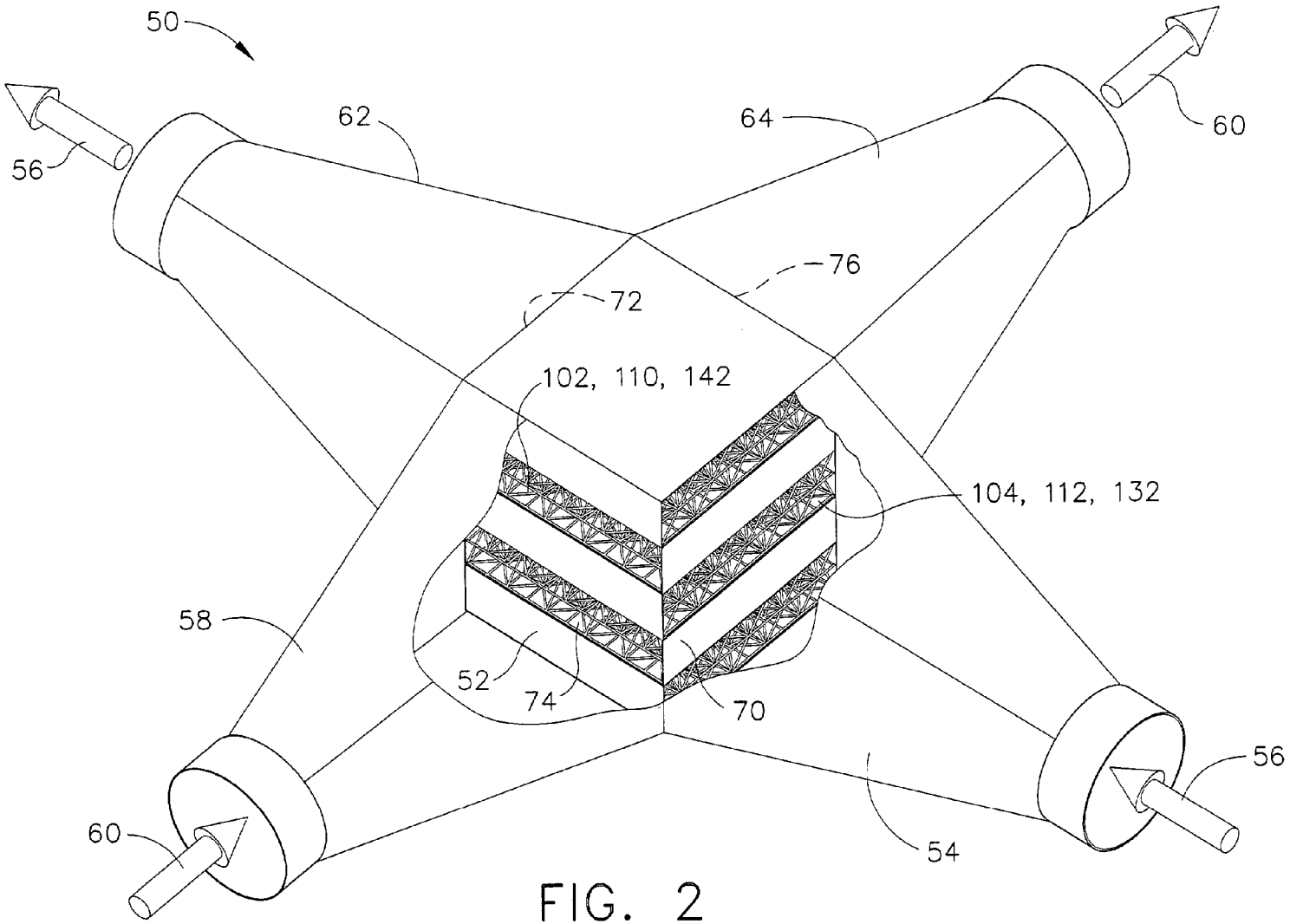
FIG. 2 is a perspective view an exemplary heat exchanger assembly for use with a gas turbine engine, such as the engine shown in FIG. 1.

FIG. 2 is a perspective view an exemplary heat exchanger assembly 50 for use with a gas turbine engine, such as engine 10 (shown in FIG. 1). Heat exchanger assembly 50 includes a heat exchanger 52, an entry duct 54 for a first fluid 56, an entry duct 58 for a second fluid 60, an exit duct 62 for first fluid 56, and an exit duct 64 for second fluid 60. Heat exchanger receives a flow of first fluid 56 from duct 54 and receives a flow of second fluid 60 from entry duct 58. Ducts 54 58, 62, and 64 are each coupled to a respective portion (not shown) of engine 10 in any suitable manner. As described below, as fluids 56 and 60 flow through heat exchanger 52, fluids 56 and 60 exchange heat. In one embodiment, first fluid 56 has a greater temperature than second fluid 60 at respective entry ducts 54 and 58. In an alternative embodiment, second fluid 60 has a greater temperature than first fluid 56 at respective entry ducts 58 and 54. Additionally, in one embodiment, first fluid 56 has a greater temperature than second fluid 60 at respective exit ducts 62 and 64. In an alternative embodiment, second fluid 60 has a greater temperature than first fluid 56 at respective exit ducts 64 and 62. In yet another alternative embodiment, first and second fluids 56 and 60 have a substantially equal temperature at respective exit ducts 62 and 64.

First fluid entry duct 54 is coupled to heat exchanger 52 such that duct 54 supplies a flow of first fluid 56 to a first side 70 of heat exchanger 52. First fluid exit duct 62 is coupled to heat exchanger 52 such that duct 62 receives a flow of first fluid 56 from a second side 72 of heat exchanger 52. Second fluid entry duct 58 is coupled to heat exchanger 52 such that duct 58 supplies a flow of second fluid 60 to a third side 74 of heat exchanger 52. Second fluid exit duct 64 is coupled to heat exchanger 52 such that duct 64 receives a flow of second fluid 60 from a fourth side 76 of heat exchanger 52.

In one embodiment, first fluid entry duct 54 is fluidly coupled to a source (not shown) that supplies a flow of air from compressor 14 to entry duct 54, and second fluid entry duct 58 is fluidly coupled to a source (not shown) that supplies a flow of exhaust gas from turbine 20 to entry duct 58. In another embodiment, first fluid entry duct 54 is fluidly coupled to a source (not shown) that supplies a flow of air from compressor 14 to entry duct 54, and heat exchanger 52 uses a flow of another fluid that is received from second fluid entry duct 58 to cool the air from compressor 14.

Figure 3:
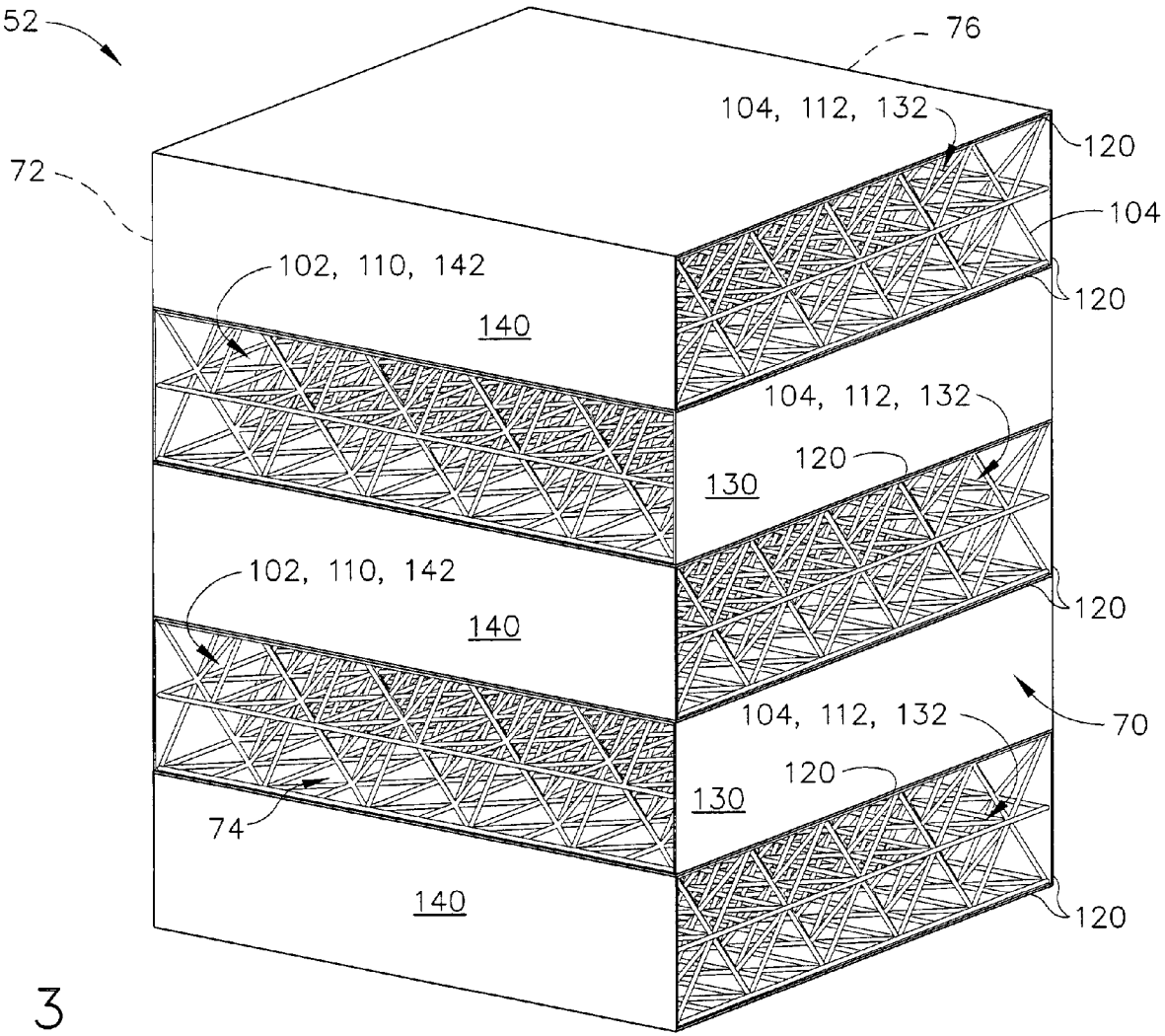
FIG. 3 is a perspective view of an exemplary heat exchanger for use with the heat exchanger assembly shown in FIG. 2.
Figure 4:
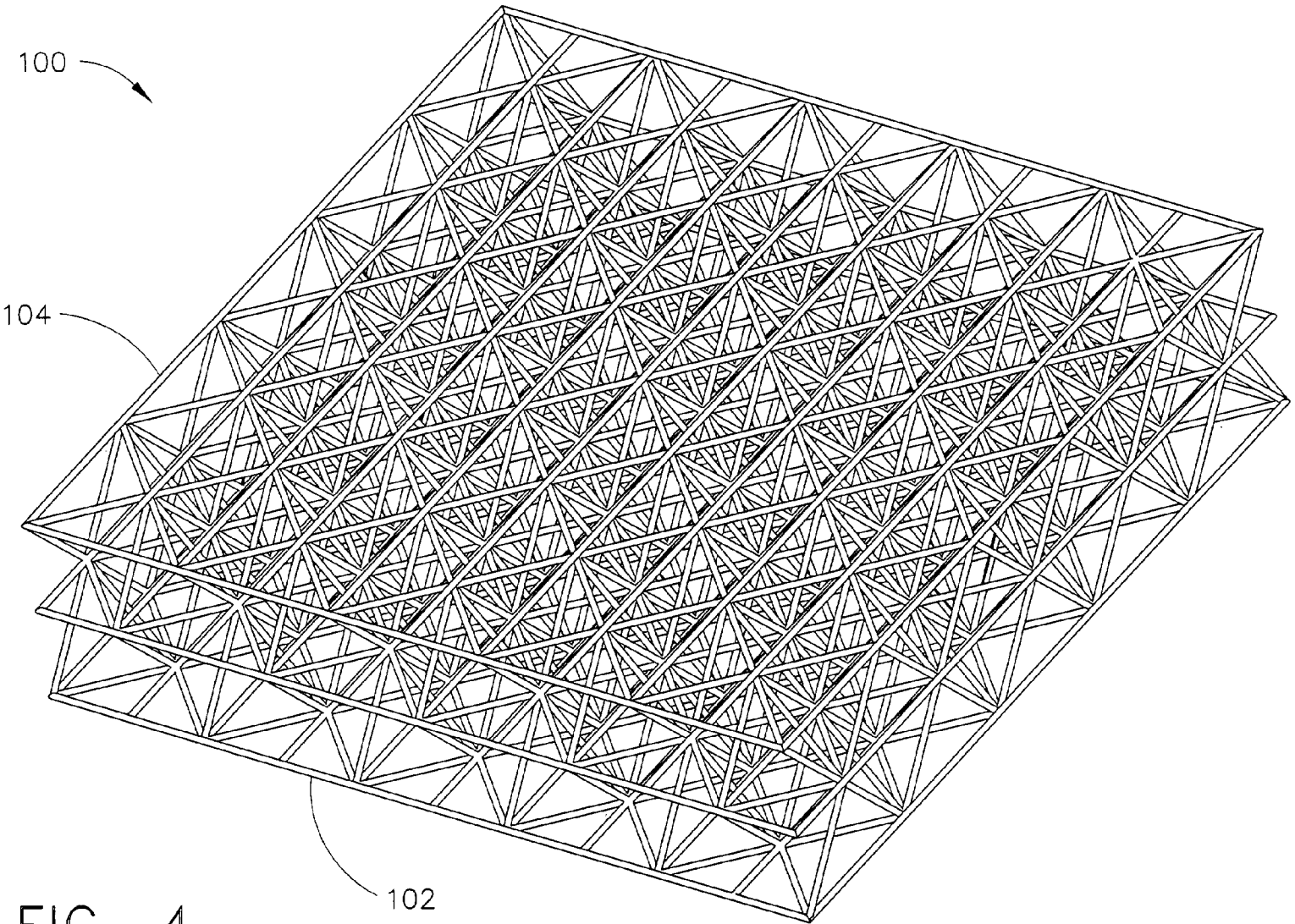
FIG. 4 is a perspective view of a portion of the heat exchanger shown in FIG. 3.
Figure 5:
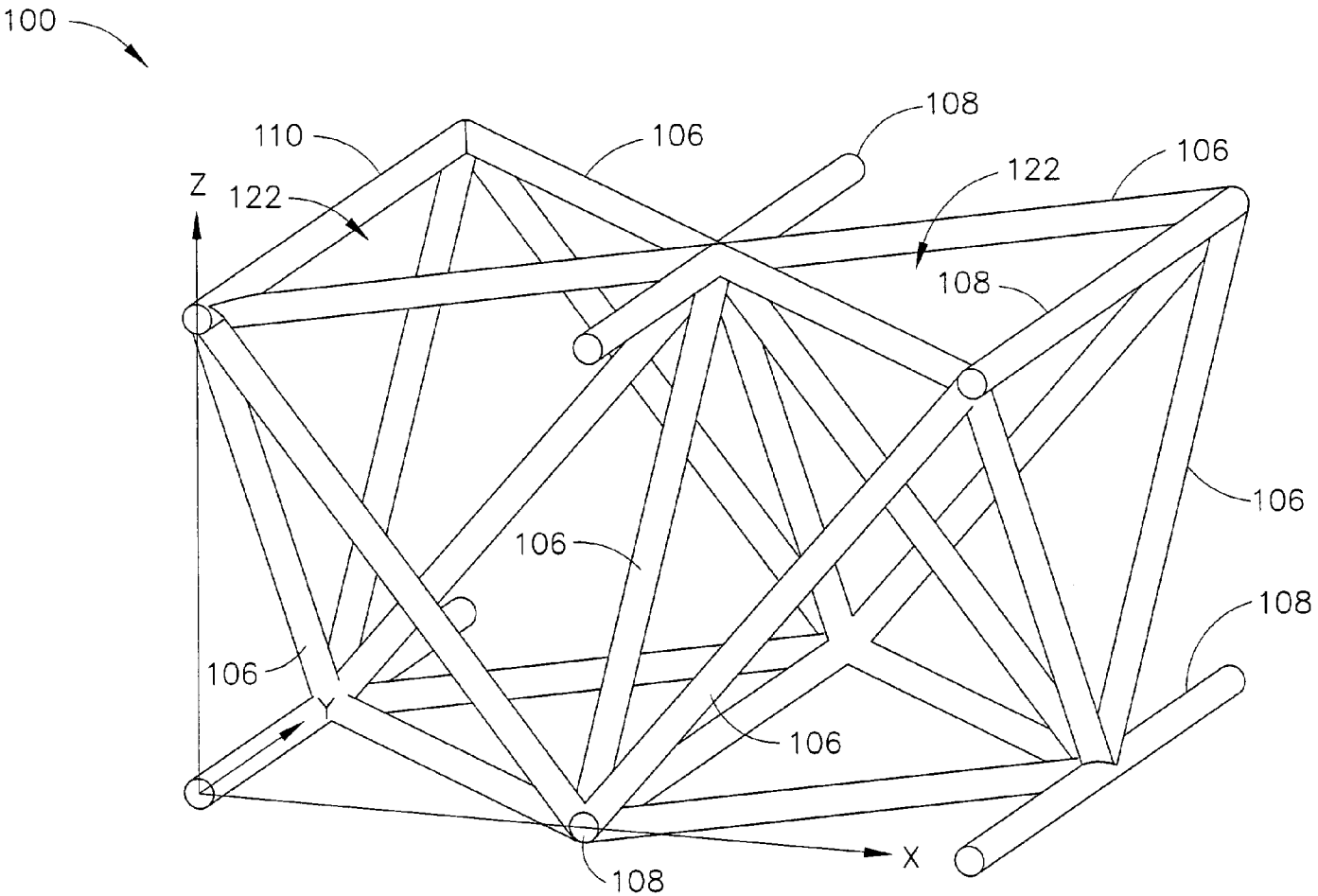
FIG. 5 is another perspective view of a portion of the heat exchanger shown in FIG. 3.

FIG. 3 is a perspective view of heat exchanger 52 (shown in FIG. 2). FIG. 4 is a perspective view of a lattice block structure 100 that defines a portion of heat exchanger 52. FIG. 5 is a perspective view of a portion of lattice block structure 100. Heat exchanger 52 includes a plurality of layers 102 and 104 of lattice block structure 100. Layers 102 and 104 are stacked on one another to form structure 100. More specifically, each layer 102 is stacked adjacent to at least one layer 104, and each layer 104 is stacked adjacent to two layers 102. Each layer 102 of structure 100 is fabricated from a lattice of individual supports 106 that are joined at respective support vertices 108. In the exemplary embodiment, supports 106 form a plurality of pyramids stacked substantially uniformly in a three-dimensional array to form layers 102 and 104, and structure 100 as a whole. However, it will be understood that the particular dimensions, geometry, and configuration of supports 106, layers 102 and 104, structure 100, and heat exchanger 52 as a whole, will vary depending on the particular application of heat exchanger assembly 50.

Lattice block structure 100, and more specifically supports 106, mechanically support the structure of heat exchanger 52 during operation of heat exchanger 52. In one embodiment, structure 100, and more specifically supports 106, are formed from fine wire segments that are sections of a continuous wire filament. In an alternative embodiment, structure 100 is formed from a substrate sheet. In another alternative embodiment, structure 100 is formed using an injection molding process. In yet another alternative embodiment, structure 100 is formed using a casting process. Additionally, in one embodiment, supports 106 are fabricated from a metallic material, such as, but not limited to steel alloy IN718, aluminum, or copper depending on the temperature and corrosion resistance desired. In one embodiment, structure 100 is formed using materials commercially available from JAMCORP USA, Wilmington, Mass., 01887.

A plurality of first barriers 120 are coupled between adjacent layers 102 and 104 to fluidly separate adjacent layers 102 and 104. First barriers 120 substantially fluidly separate adjacent layers 102 and 104 such that respective passageways 110 and 112 are defined between adjacent layers 102 and 104, and such that fluid does not leak between adjacent layers 102 and 104, and more specifically adjacent passageways 110 and 112. In the exemplary embodiment, barriers 120 form a single monolithic assembly. In one embodiment, supports 106 of each layer 102 are coupled to a respective first barrier 120, which is also coupled to supports 106 of an adjacent layer 104, such that first barriers 120 completely separate adjacent layers 102 and 104 and provide a mechanical connection between adjacent layers 102 and 104.

Heat exchanger first side 70 includes a plurality of second barriers 130 coupled thereto. Each second barrier 130 is coupled over an opening 132 to a respective layer passageway 110. Second barriers 130 are coupled over openings 132 such that second barriers 130 substantially block flow of first fluid 56 into layer passageways 110. Heat exchanger second side 72 also includes a plurality of second barriers 130 coupled thereto, wherein each second barrier 130 is coupled over openings (not shown) within second side 72 that open to respective passageways 110, such that second barriers 130 facilitate substantially blocking flow of first fluid 56 into layer passageways 110.

In one embodiment second barriers 130 are fabricated from a material having generally good thermal conductivity. Additionally, in one embodiment second barriers 130 are brazed to supports 106.

Heat exchanger third side 74 includes a plurality of third barriers 140 coupled thereto. Each third barrier 140 is coupled over an opening 142 to a respective layer passageway 112. Third barriers 140 are coupled over openings 142 such that third barriers 140 substantially block flow of second fluid 60 into layer passageways 112. Heat exchanger fourth side 76 also includes a plurality of third barriers 140 coupled thereto, wherein each third barrier 140 is coupled over openings (not shown) within fourth side 76 that open to respective passageways 112, such that third barriers 140 facilitate substantially blocking flow of second fluid 60 into layer passageways 112. Second barriers 130 also facilitate containing flow of second fluid 60 within passageways 110, and third barriers 140 also facilitate containing flow of first fluid 56 within passageways 112.

Referring now to FIGS. 1–5, in operation, first fluid entry duct 54 receives a flow of first fluid 56, in the exemplary embodiment compressed air 56 from compressor 14, and second fluid entry duct 58 receives a flow of second fluid 60, in the exemplary embodiment exhaust gas 60 from turbine 20 that has a temperature greater than compressed air 56. Second barriers 130 and entry duct 54 direct the flow of compressed air 56 through openings 132 and into passageways 112 of layers 104. Compressed air 56 flows out of passageways 112 through the openings within second side 72 that open to passageways 112 and then through first fluid exit duct 62. Third barriers 140 and entry duct 58 direct the flow of exhaust gas 60 through openings 142 and into passageways 110 of layers 102. Exhaust gas 60 flows out of passageways 110 through the openings within fourth side 76 that open to passageways 110 and then through second fluid exit duct 64. As exhaust gas 60 flows through passageways 110, exhaust gas 60 transfers heat to first barriers 120, and more specifically surface areas of first barriers 120 that are adjacent passageways 112. As compressed air 56 flows through passageways 112, air 56 absorbs the heat from the surface areas of barriers 120 that are adjacent passageways 112. Accordingly, exhaust gas 60 and compressed air 56 exchange heat through the increase in temperature gained by air 56 and the decrease in temperature experienced by gas 60. During operation of heat exchanger 52, lattice block structure 100, and more specifically supports 106, mechanically support the other individual components of heat exchanger 52, and the structure of heat exchanger 52 as a whole, to facilitate protecting heat exchanger 52 from stresses induced by the pressures of fluids 56 and 60, and by the general operation of heat exchanger 52.

The above-described heat exchanger assembly is cost-effective and highly reliable for facilitating an exchange of heat between two fluids, particularly within a gas turbine engine. More specifically, the heat exchanger assembly described above facilitates increasing a strength of a heat exchange assembly while decreasing a weight of the assembly, due in part, to the structural stiffness and weight of the lattice block structure used to construct the assembly, and a reduced number of brazed joints within the assembly. Additionally, because of barriers between layers of the lattice block structure, independent fluids within the layers may not intermix when defects and/or failures are present within the heat exchanger assembly, and more specifically the lattice block structure and brazed joints within the assembly, whether such defects are due to manufacturing or operation of the assembly. Accordingly, an efficiency of the heat exchanger assembly may degrade less over time, thereby also possibly increasing the efficiency of a gas turbine engine. As a result, the above-described assembly facilitates exchanging heat between two fluids in a cost-effective and reliable manner.

Exemplary embodiments of heat exchanger assemblies are described above in detail. The systems are not limited to the specific embodiments described herein, but rather, components of each assembly may be utilized independently and separately from other components described herein. Each heat exchanger assembly component can also be used in combination with other heat exchanger assembly components.

While the invention has been described in terms of various specific embodiments, those skilled in the art will recognize that the invention can be practiced with modification within the spirit and scope of the claims.

What is claimed is:

1. A method for exchanging heat between a gas turbine compressor discharge air and a gas turbine exhaust gas, said method comprising:

providing a heat exchanger having a stack of at least two layers of support structures comprising:

forming each support structure layer from a lattice of support members; and forming each support structure layer from at least two sub-layers; and forming each sub-layer from a plurality of support members directly coupled together such that the support members form a plurality of pyramids stacked substantially uniformly in a three-dimensional array;

substantially fluidly separating the at least two support structure layers using at least one barrier such that each layer defines a fluid passageway;

coupling the heat exchanger between a gas turbine compressor and a gas turbine exhaust assembly;

directing a flow of gas turbine compressor discharge air through a first of the fluid passageways;

directing a flow of gas turbine exhaust gas through a second of the fluid passageways that is adjacent the first fluid passageway to facilitate increasing a temperature of the compressor discharge air; and channeling at least a portion of the compressor discharge air having an increased temperature to a gas turbine combustor.

2. A method in accordance with claim 1 wherein providing a heat exchanger having a stack of at least two layers of support structures comprises providing a heat exchanger having a stack of greater than two layers of support structures.

3. A method in accordance with claim 2 wherein fluidly separating the at least two layers of support structures using at least one barrier such that each layer defines a fluid passageway comprises fluidly separating adjacent support structure layers within the stack such that a plurality of fluid passageways are defined within the stack.

4. A method in accordance with claim 3 wherein directing a flow of gas turbine compressor discharge air through a first of the fluid passageways comprises directing a flow of gas turbine compressor discharge air through a plurality of the fluid passageways, and directing a flow of gas turbine exhaust gas through a second of the fluid passageways comprises directing a flow of gas turbine exhaust gas through a plurality of the fluid passageways.

5. A method in accordance with claim 1 wherein said directing a flow of air from the compressor through a first of the fluid passageways comprises:

directing a flow of air from the compressor through a first of the fluid passageways to facilitate increasing a temperature of the compressed air; and directing a flow of combustion gases from the turbine exhaust through a second of the fluid passageways to facilitate decreasing a temperature of the combustion gases.

6. A gas turbine heat exchanger for exchanging heat between a gas turbine compressor discharge air and a gas turbine exhaust gas, said heat exchanger comprising:

a stack of at least two layers of support structures, wherein each said support structure layer comprises:

a lattice of support members; and at least two sub-layers, each sub-layer comprising a plurality of support members directly coupled together such that said support members form a plurality of pyramids stacked substantially uniformly in a three-dimensional array; and at least one barrier coupled to at least one said support structure layer such that said at least one barrier substantially fluidly separates at least two said support structure layers such that each said layer defines a fluid passageway, said at least one barrier configured to facilitate exchanging heat between the gas turbine compressor discharge air and the gas turbine exhaust gas when gas turbine compressor discharge air is directed through a first of said fluid passageways and the gas turbine exhaust gas is directed through a second of said fluid passageways that is adjacent said first fluid passageway.

7. A gas turbine heat exchanger in accordance with claim 6 wherein said stack plurality of support structure layers comprise greater than two layers, said heat exchanger comprises a plurality of said barriers, each said barrier is coupled between adjacent said layers within said stack such that a plurality of said fluid passageways are defined within said stack.

8. A gas turbine heat exchanger in accordance with claim 7 further comprising a first side and an opposite second side, said first side comprising at least one opening in flow communication with at least one of said plurality of fluid passageways, said second side comprising at least one cover coupled to said second side, said second side cover substantially covering an opening to at least one of said plurality of fluid passageways, said plurality of barriers facilitate heat transfer between the gas turbine compressor discharge air and the gas turbine exhaust gas when gas turbine compressor discharge air is directed through a first plurality of said fluid passageways and gas turbine exhaust gas is directed through a second plurality of said fluid passageways.

9. A gas turbine heat exchanger in accordance with claim 6 wherein said at least one barrier facilitates increasing a temperature of the compressed air, and decreasing a temperature of the combustion gases.

10. A gas turbine engine comprising:

at least one compressor;

at least one turbine assembly downstream from and in flow communication with said compressor, said turbine assembly comprising at least one exhaust; and a heat exchanger comprising:

a stack of at least two layers of support structures, wherein each said support structure layer comprises:

a lattice of support members; and at least two sub-layers, each sub-layer comprising a plurality of support members directly coupled together such that said support members form a plurality of pyramids stacked substantially uniformly in a three-dimensional array; and at least one barrier coupled to at least one said support structure layer such that said at least one barrier substantially fluidly separates at least two said support structure layers such that each said layer defines a fluid passageway, said at least one barrier facilitates exchanging heat between compressed air discharged from said at least one compressor and a second fluid when compressed air is directed through a first of said fluid passageways and said second fluid is directed through a second of said fluid passageways that is adjacent said first fluid passageway.

11. An engine in accordance with claim 10 wherein said second fluid comprises combustion gases discharged from said at least one turbine exhaust, said at least one barrier facilitates increasing a temperature of compressed air when compressed air is directed through said first fluid passageway, and decreasing a temperature of combustion gas when combustion gases are directed through said second fluid passageway.

12. An engine in accordance with claim 10 wherein said at least one barrier facilitates decreasing a temperature of compressed air directed through said first fluid passageway, and facilitates increasing a temperature of second fluid directed through said second fluid passageway.

* * * * *